US009603434B2

(12) United States Patent
Zhu et al.

(10) Patent No.: US 9,603,434 B2
(45) Date of Patent: Mar. 28, 2017

(54) MECHANISM OF LIPSTICK TUBE

(71) Applicant: ZHEJIANG AXILONE SHUNHUA ALUMINUM & PLASTIC CO., LTD, Zhejiang (CN)

(72) Inventors: Weifeng Zhu, Zhejiang (CN); Bokun Ni, Zhejiang (CN); Yongqing Fang, Zhejiang (CN); Linbin Wang, Zhejiang (CN)

(73) Assignee: Zhejiang Axilone Shunhua Aluminum & Plastic Co., Ltd., Zhejiang (CN)

( * ) Notice: Subject to any disclaimer, the term of this patent is extended or adjusted under 35 U.S.C. 154(b) by 239 days.

(21) Appl. No.: 14/412,057

(22) PCT Filed: Sep. 22, 2013

(86) PCT No.: PCT/CN2013/083915
§ 371 (c)(1),
(2) Date: Dec. 30, 2014

(87) PCT Pub. No.: WO2014/166212
PCT Pub. Date: Oct. 16, 2014

(65) Prior Publication Data

US 2015/0164202 A1 Jun. 18, 2015

(30) Foreign Application Priority Data

Apr. 10, 2013 (CN) ..... 2013 2 0177695 U

(51) Int. Cl.
*A45D 40/04* (2006.01)
*A45D 40/06* (2006.01)

(52) U.S. Cl.
CPC ..... *A45D 40/04* (2013.01); *A45D 40/06* (2013.01)

(58) Field of Classification Search
None
See application file for complete search history.

(56) References Cited

U.S. PATENT DOCUMENTS 1,966,884 A * 7/1934 Coe ..... A45D 40/06 401/78
2,471,483 A * 5/1949 Frydlender ..... A45D 40/06 401/78

(Continued)

FOREIGN PATENT DOCUMENTS

CN 2176670 Y 9/1994
CN 2704247 Y 6/2005

(Continued)

OTHER PUBLICATIONS

International Search Report for Application No. PCT/CN2013/083915 dated Jan. 23, 2014.

(Continued)

*Primary Examiner* — David Walczak
(74) *Attorney, Agent, or Firm* — Alston & Bird LLP

(57) ABSTRACT

A lipstick tube cartridge core comprising a ball (1), a fork (2), a spiral (3), and a cartridge (4). The spiral (3) and the cartridge (4) are provided therebetween with a keyway structure (33 and 43) arranged in the axial direction and an engaging ring (31 and 42) and engaging groove (32 and 41) structure arranged in the circumferential direction. As the spiral (3) and the cartridge (4) are provided therebetween with the keyway structure (33) arranged in the axial direction and the engaging ring (31 and 42) and engaging groove (32 and 41) structure arranged in the circumferential direction, retention of the spiral (3) and of the cartridge (4) is implemented without using a glue, thus preventing a scenario in which a cosmetic paste is contaminated by the glue.

10 Claims, 4 Drawing Sheets

(56) References Cited

U.S. PATENT DOCUMENTS

| | | | | | |
|---|---|---|---|---|---|
| 2,797,802 | A | * | 7/1957 | Hopgood | A45D 40/06<br>401/78 |
| 3,124,244 | A | * | 3/1964 | Hopgood | A45D 40/06<br>29/434 |
| 3,511,575 | A | * | 5/1970 | Berins | A45D 40/06<br>401/78 |

FOREIGN PATENT DOCUMENTS

| | | | |
|---|---|---|---|
| CN | 200976929 | Y | 11/2007 |
| CN | 201533649 | U | 7/2010 |
| CN | 201767295 | U | 3/2011 |
| CN | 202184308 | U | 4/2012 |
| CN | 202635996 | U | 1/2013 |
| FR | 2639260 | A1 | 5/1990 |
| JP | 2001 231628 | A | 8/2001 |
| JP | 2004 350954 | A | 12/2004 |

OTHER PUBLICATIONS

Office Action for European Application No. 13 88 1859 dated Jan. 3, 2017.

* cited by examiner

MECHANISM OF LIPSTICK TUBE

TECHNICAL FIELD OF THE INVENTION

The disclosure relates to the packaging supplies of cosmetics, in particular to a mechanism of a lipstick tube for accommodating pasty cosmetics.

BACKGROUND OF THE INVENTION

Currently, makeup has become an indispensible part of people's daily life. There are many varieties of cosmetics, such as powder, liquid and paste. To facilitate the use of cosmetics, people usually make different cosmetics into different shapes and fill them in suitable containers. Wherein the cosmetics with the shape of powder stick, such as lipstick, lip cream, concealer, skin whitening stick and sun cream stick, are filled in the powder stick tube, collectively known as lipstick tube, to be designed and manufactured.

Currently, the lipstick tubes on the market usually include a cover, a mechanism and a base, wherein the mechanism includes an A-shell, an innerbody, a cup and a spiral, and the assembled mechanism is sleeved in the base and then matches with the cover to form the finished product of lipstick tube. At present, the lubricating oil and glue are used to realize a smoothly, flexibly relative movement and fixation among components in most lipstick tubes. Therefore, such defects, such as increased production cost, complex process, and easily causing pollution, may occur.

The patent numbered CN201767295U discloses a mechanism of a lipstick tube, including an A-shell, a spiral, an innerbody and a cup, which are coaxially sleeved from outside to inside in sequence, wherein the A-shell is fixedly connected with the spiral; a spiral guide groove is provided on the inner circumference of the spiral, a notch is provided on the wall surface of the innerbody along the axial direction thereof, a bulge which passes through the notch and extends into the guide groove is provided on the outer circumference of the cup, and a plurality of bumps which are fixed on the inner circumference of the spiral or on the outer circumference of the innerbody are provided between the bottom end of the spiral and the innerbody.

The plurality of bumps, provided between the bottom end of the spiral and the innerbody, of the mechanism of the abovementioned utility model adjusts the distance between the spiral and the innerbody, so as to control the friction and the torsion during rotation between the spiral and the innerbody. However, the bumps are poor in adjustment of themselves and are easy to jam when the spiral and the innerbody move relative to each other, so that the lubricants are needed, thereby causing the hidden trouble of polluting the beauty cream.

The patent numbered CN201533649U discloses a powder stick tube, including an A-shell, a spiral, an innerbody and a cup, wherein the A-shell is sleeved outside the periphery of the spiral and is fixed with the spiral; the spiral is sleeved outside the periphery of the innerbody and is axially fixed with the innerbody; the cup is inside the innerbody and is provided with a bulge; and the innerbody is provided with an axial straight slot. A spiral guide groove is provided on the inner wall of the spiral; the bulge of the cup passes through the straight slot on the innerbody to fall into the guide groove of the spiral; and the spiral and the innerbody are axially fixed in the following way: an outward expanding ring is provided at the top of the innerbody, wherein the outer diameter of the expanding ring is greater than the inner diameter of the spiral, and the top of the spiral is adjacent to the lower side of the expanding ring; and a ring of plate-like bulge is provided on the circumference of the innerbody, wherein the plate-like bulge is between the innerbody and the spiral and is in an arc shape along the axial section of the innerbody and the spiral.

In the solution above, because the ring of the plate-like bulge is formed on the circumference of the innerbody, wherein the plate-like bulge is between the innerbody and the spiral and is in an arc shape along the axial section of the innerbody and the spiral, an expanding force may be generated between the innerbody and the spiral so as to ensure the generation of a certain torsion and a lubricant and smooth hand feeling, thereby reducing the use of lubricants.

In the structure above, through adding the plate-like bulge, it provides the expanding force generated between the spiral and the innerbody, so as to reduce the use of lubricants, whereas, the A-shell and the spiral are still fixed by glue. During production, it is likely to pollute the beauty cream, so that such hidden trouble such as the deterioration of the beauty cream may exist.

THE DISCLOSURE TO THE INVENTION

Technical Problem

The disclosure provides a mechanism of a lipstick tube without oil nor glue, in order to solve the problem that the glue, by which the spiral and the A-shell in the existing mechanism of the lipstick tube are fixed, is easy to overflow and pollute lipstick.

Solutions of the Problem

A mechanism of a lipstick tube includes a cup, an innerbody, a spiral and an A-shell, wherein an axial key slot structure and a circumferential clasp clamping groove structure are provided between the spiral and the A-shell.

The key slot structure is used for the circumferential fixation of the spiral and the A-shell, while the clasp clamping groove structure is used for the axial fixation of the spiral and the A-shell. During the assembly, the spiral and the A-shell are fixedly matched with each other by the two structures above mentioned, namely, the A-shell and the spiral are fixedly matched with each other in a sleeved way without glue, thereby effectively solving the pollution problem caused by the glue.

The mechanism is generally mounted on a base. The parts of the cup, the innerbody, the spiral and the A-shell adjacent to and far away from the base are defined as a lower side and an upper side respectively; and the two ends of the cup, the innerbody, the spiral and the A-shell adjacent to and far away from the base are defined as a bottom and a top respectively.

To stably transmit the force on the A-shell to the spiral, preferably, the key slot structure is of a spline structure including a spline provided inside the A-shell and a key slot provided on the outer wall of the spiral, wherein the number of the spline may be less than that of the key slot, so that the A-shell and the spiral match with each other conveniently.

The spline structure can be provided in a local area, preferably, the spline on the inner wall of the A-shell is provided in the middle of the A-shell, and the axial length is ½ to ⅘ length of the A-shell.

More preferably, the depth of the key slot is 0.10 to 0.15 mm, and the number is 50 to 120.

The clasp clamping groove structure includes a first clasp provided on an outer wall of the spiral, and a first groove located on an inner wall of the A-shell and matched with the first clasp.

The A-shell and the spiral fixed by a set of clasp clamping groove structure may be disengaged. Preferably, a second clamping groove next to the first clasp is provided on the outer wall of the spiral, and a second clasp matched with the second groove is provided on the inner wall of the A-shell, and the second clasp is next to the first groove. Thus, a junction between the first clasp and the second clamping groove and a junction between the first clamping groove and the second clasp are matched to be a structure, and preferably, the step structure is a right-angle step structure for more reliable engagement and positioning.

The clasps and the clamping grooves are formed by stamping. For the aesthetic appearance and easy manufacturing of the A-shell, the A-shell includes an A-shell body and a thin wall section connected at the bottom of the A-shell body, wherein a part of the thin wall section is folded inwards to form a folding part, which constitutes the second clasp, and a groove between the folding part and the A-shell body constitutes the first clamping groove, so that the notch part of the thin wall section can be folded to the inside of the A-shell, thereby being unlikely to scratch with other components.

According to the processing method above, the folded location of the folding part is a bottom edge of the A-shell, and preferably, an arc chamfer is provided on the bottom edge of the A-shell to facilitate the clasping fit of the A-shell and the spiral.

Preferably, a guide slope, the upper radius of which is less than the radius of the clasp, is provided at the top of the first clasp, so that the A-shell can be guided to move downwards.

Preferably, the wall thickness ratio between the thin wall section and the A-shell body is 13 to 23, and a height of the thin wall section along a axial direction of the A-shell is 2.5 mm to 5.0 mm.

More preferably, a height of the folding part along the axial direction of the A-shell is 1.0 mm to 2.0 mm.

Preferably, a ring of a plate-like bulge is provided on the circumference of the innerbody and the plate-like bulge is between the innerbody and the spiral. The outer diameter of the bulge is greater than the inner diameter of the spiral. After the assembly, the spiral presses the plate-like bulge to be curved so as to generate a certain expanding force between the spiral and the innerbody.

Since the clamping grooves and the clasps match with each other to implement the axial fixation of the spiral and the A-shell, the clamping grooves or the clasps provided on the spiral can be further provided on the parts (such as the innerbody and the base) axially fixed with respect to the spiral.

A spiral notch is provided on the inner wall of the spiral. The innerbody is provided with an axial guide groove. The cup is provided with a convex foot which passes through the guide groove and extends into the notch.

When the spiral is rotated, the convex foot moves along the spiral notch, and the whole cup axially moves along the guide groove, so that the cream can be hidden and exposed.

To move the cup more stably, the number of guide grooves and convex feet is two respectively, which are provided symmetrically.

To axially fix the innerbody with respect to the spiral, a limit ring is provided on the outer wall at each of the two ends of the innerbody, and the spiral is snapped between the two limit rings.

To position the cup at the highest moving point and the lowest moving point for preventing the cream from being moved during use, a notch is provided at each of the two ends of the guide groove. In use, when the cup is at the highest point or the lowest point, the convex feet of the cup will be snapped in the notches to realize the axial positioning.

Preferably, the two notches are provided at different sides of the guide grooves.

To facilitate the assembly of the mechanism, a cutting extended to the guide grooves is provided at the top of the innerbody.

In the mechanism with the structure above, after the assembly, the convex feet of the cup pass through the guide grooves on the innerbody and extend into the notches of the spiral; the spiral is snapped between the two limit rings of the innerbody; the end of the plate-like bulge on the innerbody is resisted against the inner wall of the spiral, so that a certain gap may be formed between the inner wall of the spiral and the outer wall of the innerbody, the friction applied on the spiral is reduced during the rotation, the rotation is smoother and certain torsion may be generated. The A-shell and the spiral are fixedly matched with each other, so that the spiral may be driven to rotate by rotating the A-shell.

Advantages of the Invention

The disclosure has the following advantages:

Through the axial key slot structure and the circumferential clasp groove structure between the spiral and the A-shell, the mechanism of the lipstick tube of the disclosure implements the fixation of the spiral and the A-shell without glue, so that beauty cream cannot be polluted by the glue.

DETAILED DESCRIPTION OF THE EMBODIMENTS

Figure 1:
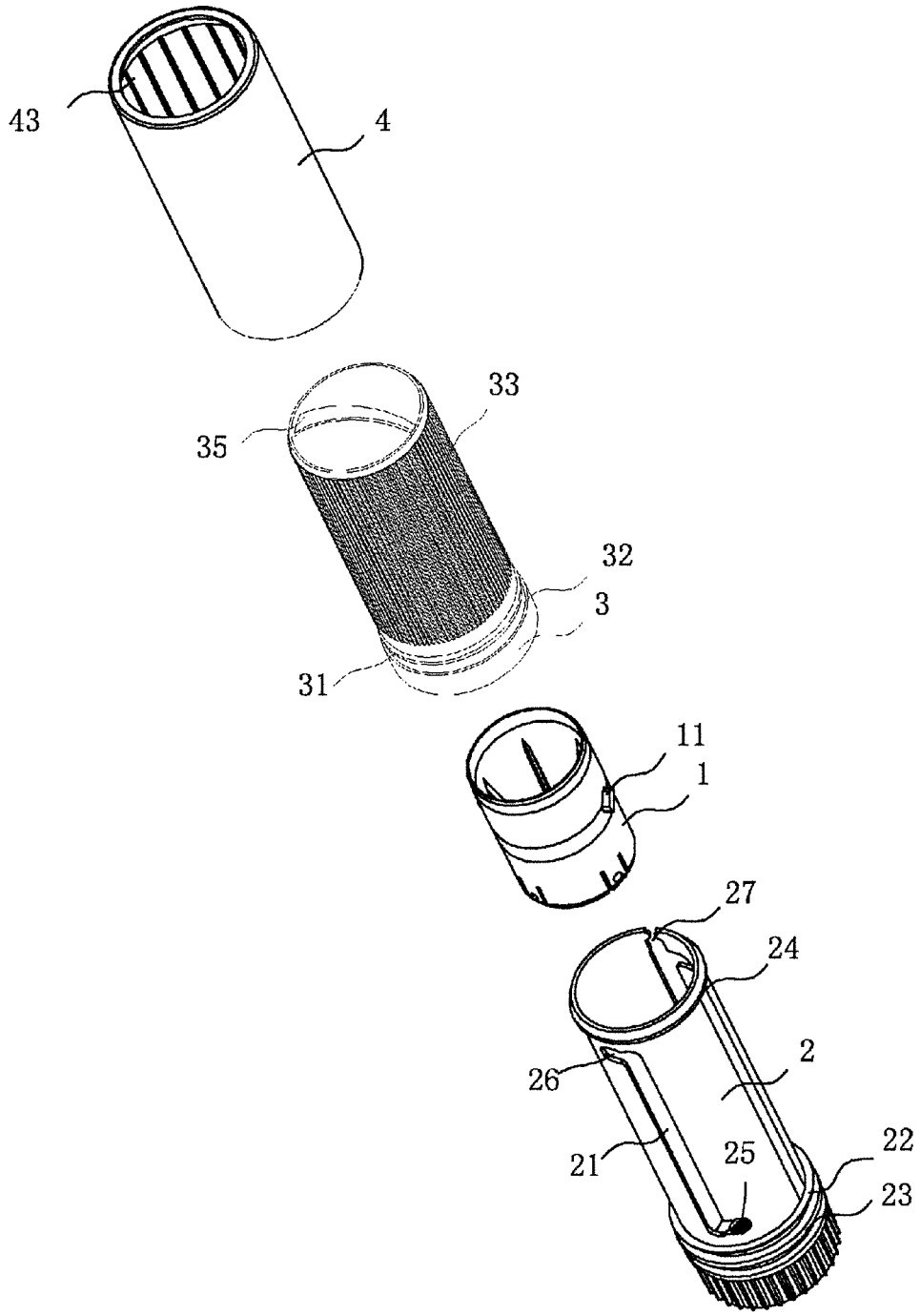
FIG. 1 is an exploded view of a mechanism of the disclosure.
Figure 2:
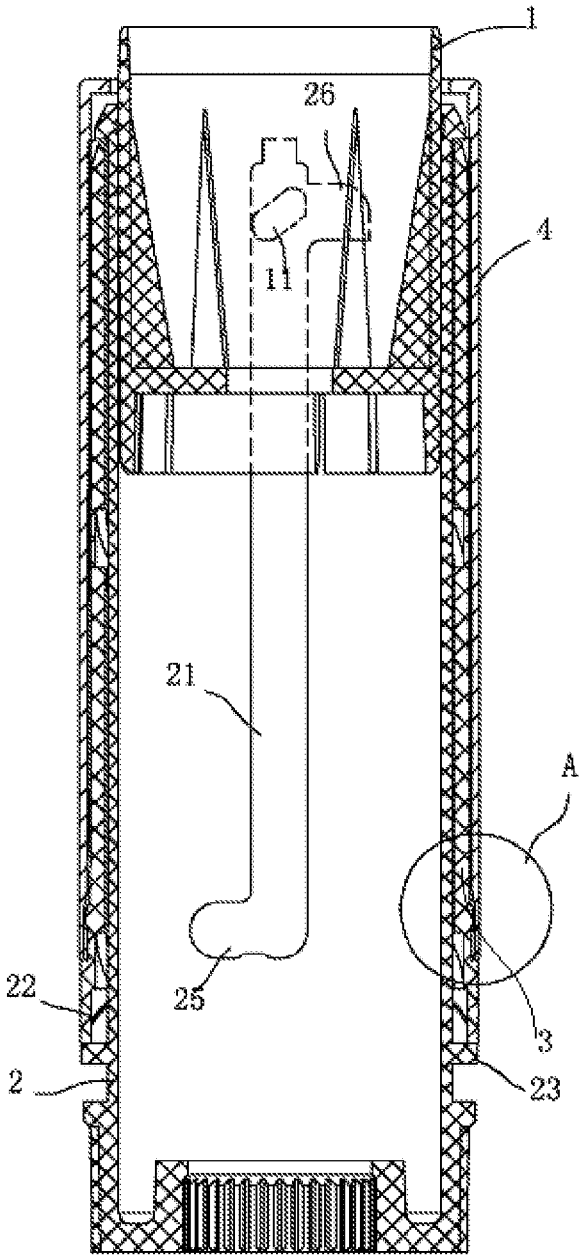
FIG. 2 is an axial sectional view of a mechanism of the disclosure.

As shown in FIGS. 1 and 2, the embodiment includes a cup 1, an innerbody 2, a spiral 3, and an A-shell 4, which are coaxially sleeved together from inside to outside in turn, wherein the cup 1 is used for filling cream.

Wherein, a spiral notch 35 is formed on the inner wall of the spiral 3. The innerbody 2 is provided with two axial guide grooves 21 which are symmetrically distributed on the innerbody 2. An upper notch 26 and a lower notch 25 are provided at two ends of the guide groove 21 respectively. The cup 1 is provided with a convex foot 11 passing through the guide groove 21 and extending into the notch 35. When the cup is at the highest point or the lowest point, the convex foot 11 may be snapped into the upper notch 26 or the lower notch 25 to prevent the convex foot 11 from leaving the notch 35, thereby avoiding damaging the mechanism in case of excessive rotation of the spiral 3.

An upper limit ring 24 and a lower limit ring 23 are provided on the outer walls at two ends of the innerbody 2 respectively. When assembled, the spiral 3 is sleeved outside the innerbody 2 and is snapped between the upper limit ring 24 and the lower limit ring 23 to implement the axial fixation of the spiral 3 and the innerbody 2.

To facilitate the installation, a cutting 27 is provided at the top of the innerbody 2 and extends to the guide groove 21. During assembling, open the cutting 27 so that the cup 1 can extend into the innerbody 2 conveniently, or close the cutting 27 so that the spiral 3 is sleeved outside the innerbody 2.

After the assembly, the A-shell 4 is rotated in the left and right direction to drive the spiral 3 to rotate. At this time, the notch 35 on the inner wall of the spiral 3 drives the convex foot 11 of the cup 1 to move, and the cup 1 can only move along the axial direction because of the limit function of the guide groove 21 on the innerbody 2, thereby implementing the extension and withdrawal operation of cream on the cup 1.

Figure 3:
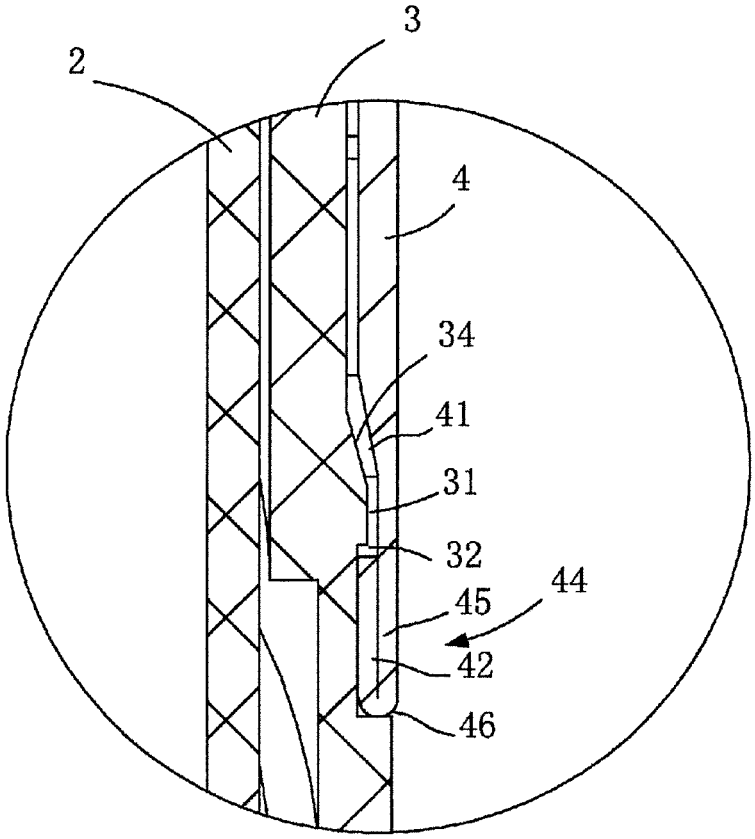
FIG. 3 is a local enlarged view of part A in FIG. 2.
Figure 4:
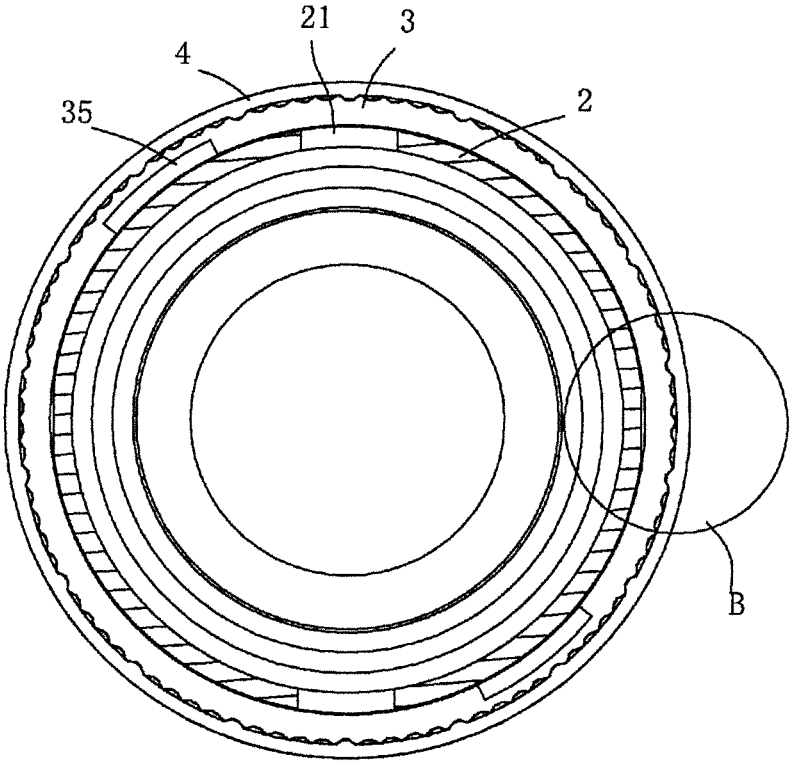
FIG. 4 is a radial sectional view of a mechanism of the disclosure.
Figure 5:
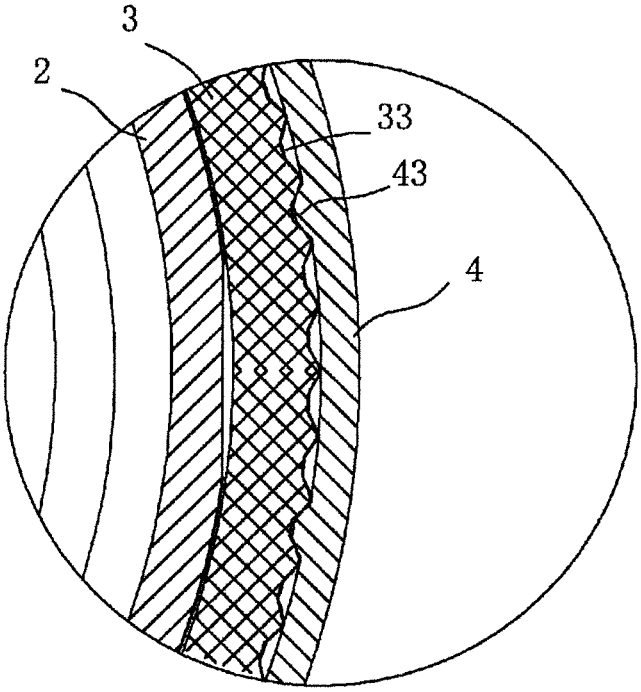
FIG. 5 is a local enlarged view of part B in FIG. 4.

The structures above are general designs of the existing mechanism. The improvement of the disclosure mainly lies in the fixation form of the spiral 3 and the A-shell 4. As shown in FIGS. 3 to 5, key slots 33 and clasps 31 are provided on the outer wall of the spiral 3, and correspondingly, splines 43 and clamping grooves 41 matching with each other are provided on the inner wall of the A-shell 4 so as to implement the circumferential fixation and the axial fixation of the spiral 2 and the A-shell 4. Such connection form is free from glue so as to prevent the cream from being polluted by the glue.

To facilitate the clasp 31 to enter into the clamping groove 41, a guide slope 34, the upper radius of which is less than that of the clasp, a conical surface actually, is provided at the top of the clasp 31, and has the function to guide the spiral 3 and the A-shell 4 to be assembled.

The spiral 3 and the A-shell 4 may be disengaged under a stronger push-pull force when only depending on a set of clasp groove structure. In the embodiment, a clamping groove 32 next to the clasp 31 may be further arranged on the outer wall of the spiral 3, a clasp 42 next to the clamping groove 41 may be further provided on the inner wall of the A-shell 4, and a junction between the clasp 31 and the clamping groove 32 and a junction between the clamping groove 41 and the clasp 42 are matched to form a vertical step structures, thus a bite fit, is formed so that the spiral 3 and the A-shell 4 can be connected more firmly. The clasps or the clamping grooves above could be formed by stamping. To facilitate the manufacturing, the clamping groove 41 and the clasp 42 in the embodiment are molded in the following way:

Firstly, the inner wall of the bottom of the A-shell 4 is stamped to form a thin wall section 44, a part of which is folded inwards to form a folding part 45. The folding part 45 forms the clasp 42. The groove between the folding part 45 and the A-shell body is the clamping groove 41. The folded part of the folding part 45 constitutes the bottom edge 46 of the A-shell 4, and an arc chamfer is provided at the bottom edge 46 of the A-shell 4 to facilitate the assembly.

In the embodiment, the thickness ratio between the thin wall section 44 and the A-shell body is 12, and the height of the thin wall section 44 along the axial direction of the A-shell 4 is 3.5 mm. The height of the folding part (namely, the clasp 42) along the axial direction of the A-shell 4 is 1.4 mm, and the axial length of the clamping groove 32 is 1.5 mm, slightly greater than the length of the folding part 45.

The splines 43 and the key slots 33 match with each other to form a key slot structure providing a circumferential fixation between the A-shell 4 and the spiral 3. In the embodiment, the splines 43 on the inner wall of the A-shell 4 are provided in the middle of the A-shell 4, and the lengths thereof in the axial direction is 34 of the length of the A-shell 4. The depth of the key slots 33 on the outer wall of the spiral 3 is 0.12 mm, and the number of the key slots is 90, while the number of the splines 43 is much less than that of the key slots 33 so that the assembly is more convenient.

A ring of a plate-like bulge 22 is provided on the circumference of the innerbody 2, the plate-like bulge 22 is between the innerbody 2 and the spiral 3, and the inner radius of the spiral 3 is less than the outer radius of the bulge 22. After the assembly, the plate-like bulge 22 becomes curved by the pressure of the spiral 3 so as to form an expanding force on the spiral 3, thus generating a certain torsion and lubricant feeling when the product is rotated.

In conclusion, the disclosure first uses the axial key slot structure and the circumferential clasp clamping groove structure to make the spiral 3 fixedly fit with the A-shell 3, so that glue is omitted. Accordingly, not only the manufacturing cost is reduced, but also the cream on the cup 1 is prevented from being polluted by the glue.

What is claimed is:

1. A mechanism of a lipstick tube, comprising a cup (1), an innerbody (2), a spiral (3) and an A-shell (4), wherein an axial key slot structure and a circumferential clasp clamping groove structure are provided between the spiral (3) and the A-shell (4), wherein the key slot structure comprises key slots (33) and splines (43), the clasp clamping groove structure comprises a first clasp (31) and a first clamping groove (41), the key slots (33) and the first clasp (31) are provided on an outer wall of the spiral (3), the splines (43) and the clamping grooves (41) are provided on an inner wall of the A-shell (4), the key slot structure is used to implement a circumferential fixation of the spiral (2) and the A-shell (4), and the clasp clamping groove structure is used to implement an axial fixation of the spiral (2) and the A-shell (4).

2. The mechanism of the lipstick tube according to claim 1, wherein the first clamping groove (41) is matched with the first clasp (31).

3. The mechanism of the lipstick tube according to claim 2, wherein a second clamping groove (32) next to the first clasp (31) is provided on the outer wall of the spiral (3); a second clasp (42) matched with the second clamping groove (32) is provided on the inner wall of the A-shell (4); and the second clasp (42) is next to the first clamping groove (41).

4. The mechanism of the lipstick tube according to claim 3, wherein a junction between the first clasp (31) and the second clamping groove (32) and a junction between the first clamping groove (41) and the second clasp (42) are matched to be a vertical step structure.

5. The mechanism of the lipstick tube according to claim 3, wherein the A-shell (4) comprises an A-shell body and a thin wall section (44) connected at the bottom of the A-shell body; a part of the thin wall section (44) is folded inwards to form a folding part (45), which constitutes the second clasp (42); and a groove between the folding part (45) and the A-shell body constitutes the first clamping groove (41).

6. The mechanism of the lipstick tube according to claim 2, wherein an arc chamfer is provided on a bottom edge of the A-shell (4).

7. The mechanism of the lipstick tube according to claim 2, wherein a guide slope (34) is provided at the top of the first clasp (31).

8. The mechanism of the lipstick tube according to claim 1, wherein a ring of a plate-like bulge (22) is provided on the circumference of the innerbody (2), the plate-like bulge (22)

is between the innerbody (2) and the spiral (3), and the outer diameter of the plate-like bulge is greater than the inner diameter of the spiral (3).

9. A mechanism of a lipstick tube, comprising a cup (1), an innerbody (2), a spiral (3) and an A-shell (4), wherein an axial key slot structure and a circumferential clasp clamping groove structure are provided between the spiral (3) and the A-shell (4), wherein the clasp clamping groove structure comprises a first clasp (31) provided on an outer wall of the spiral (3), and a first clamping groove (41) located on an inner wall of the A-shell (4) and matched with the first clasp (31), wherein a second clamping groove (32) next to the first clasp (31) is provided on the outer wall of the spiral (3); a second clasp (42) matched with the second clamping groove (32) is provided on the inner wall of the A-shell (4); and the second clasp (42) is next to the first clamping groove (41), wherein a junction between the first clasp (31) and the second clamping groove (32) and a junction between the first clamping groove (41) and the second clasp (42) are matched to be a vertical step structure.

10. A mechanism of a lipstick tube, comprising a cup (1), an innerbody (2), a spiral (3) and an A-shell (4), wherein an axial key slot structure and a circumferential clasp clamping groove structure are provided between the spiral (3) and the A-shell (4), wherein the clasp clamping groove structure comprises a first clasp (31) provided on an outer wall of the spiral (3), and a first clamping groove (41) located on an inner wall of the A-shell (4) and matched with the first clasp (31), wherein a second clamping groove (32) next to the first clasp (31) is provided on the outer wall of the spiral (3); a second clasp (42) matched with the second clamping groove (32) is provided on the inner wall of the A-shell (4); and the second clasp (42) is next to the first clamping groove (41), wherein the A-shell (4) comprises an A-shell body and a thin wall section (44) connected at the bottom of the A-shell body; a part of the thin wall section (44) is folded inwards to form a folding part (45), which constitutes the second clasp (42); and a groove between the folding part (45) and the A-shell body constitutes the first clamping groove (41).

* * * * *